US010774825B2

(12) United States Patent
Trainer et al.

(10) Patent No.: US 10,774,825 B2
(45) Date of Patent: Sep. 15, 2020

(54) PERSONAL AIR SAMPLING PUMP ASSEMBLY

(71) Applicant: IDEAL Industries, Inc., Sycamore, IL (US)

(72) Inventors: Brandon Trainer, Bedford (GB); Steve Tearle, Bedford (GB); Aamir Qureshi, Bedford (GB)

(73) Assignee: IDEAL Industries, Inc., Sycamore, IL (US)

( * ) Notice: Subject to any disclaimer, the term of this patent is extended or adjusted under 35 U.S.C. 154(b) by 394 days.

(21) Appl. No.: 15/136,377

(22) Filed: Apr. 22, 2016

(65) Prior Publication Data

US 2017/0022985 A1 Jan. 26, 2017

Related U.S. Application Data

(60) Provisional application No. 62/153,167, filed on Apr. 27, 2015.

(51) Int. Cl.
*F04B 45/04* (2006.01)
*F04B 39/12* (2006.01)
(Continued)

(52) U.S. Cl.
CPC ..... *F04B 45/04* (2013.01); *F04B 39/005* (2013.01); *F04B 39/0027* (2013.01);
(Continued)

(58) Field of Classification Search
None
See application file for complete search history.

(56) References Cited

U.S. PATENT DOCUMENTS 2,405,466 A 8/1946 Tabb
3,282,224 A * 11/1966 Bock ..... B60S 1/481 417/413.1
(Continued)

FOREIGN PATENT DOCUMENTS

CN 2262114 Y 9/1997
GB 440693 A 1/1936
(Continued)

OTHER PUBLICATIONS

European Patent Office, supplementary European search report issued on EP patent application No. 16786954.4, dated Apr. 10, 2018, 7 pages.
(Continued)

*Primary Examiner* — Peter J Bertheaud
*Assistant Examiner* — Geoffrey S Lee
(74) *Attorney, Agent, or Firm* — Greenberg Traurig, LLP

(57) ABSTRACT

A personal air sampling pump assembly includes a motor having a reciprocating piston for operating a diaphragm assembly. The diaphragm includes a valve head including a fluid inlet and a fluid outlet and a fluid chamber defining a fluid path between the inlet and outlet. A first and second diaphragm sealing engaging the valve head and enclosing the fluid chamber. The first diaphragm includes a piston diaphragm membrane portion coupled to the piston for reciprocating with the piston and wherein reciprocation of the piston causes a change in air pressure within the fluid chamber to cause air to move from the fluid inlet toward the fluid outlet. Both the first and second diaphragms include a damper membrane portion, which cooperate to reduce an amplitude of pulsation in the airflow at the fluid inlet and fluid outlet.

17 Claims, 14 Drawing Sheets

(51) Int. Cl.
*F04B 39/00* (2006.01)
*F04B 53/10* (2006.01)
*F04B 45/047* (2006.01)

(52) U.S. Cl.
CPC ..... *F04B 39/0055* (2013.01); *F04B 39/0072* (2013.01); *F04B 39/121* (2013.01); *F04B 39/123* (2013.01); *F04B 39/125* (2013.01); *F04B 45/047* (2013.01); *F04B 53/109* (2013.01)

(56) References Cited

U.S. PATENT DOCUMENTS 3,814,552 A 6/1974 Guggenheim et al.
4,063,824 A 12/1977 Baker et al.
4,091,674 A 5/1978 Amey
4,432,248 A * 2/1984 Lalin ..... G01N 1/2273 73/863.03
4,565,501 A * 1/1986 Laurendeau ..... F02M 37/046 417/267
5,107,713 A 4/1992 Peck et al.
5,205,326 A 4/1993 Paley et al.
5,380,164 A * 1/1995 Fry ..... B41J 2/17596 347/85
5,732,741 A 3/1998 Shiery
6,257,847 B1 * 7/2001 Silver ..... A61M 1/06 251/208
6,478,052 B1 11/2002 Conley et al.
6,808,517 B2 * 10/2004 Greter ..... A61M 1/06 604/500
7,008,400 B2 * 3/2006 Silver ..... A61M 1/06 119/14.24
8,366,421 B2 2/2013 Munakata et al.
8,512,010 B2 * 8/2013 Stutz ..... F04B 43/0054 417/413.1
9,243,710 B2 * 1/2016 Henriques, Jr. ..... F16J 1/10
9,644,622 B2 * 5/2017 Stutz ..... F04B 43/0054
2003/0031572 A1 * 2/2003 Tearle ..... F04B 43/0054 417/534
2007/0292276 A1 * 12/2007 Stutz ..... F04B 43/0054 417/137
2009/0246035 A1 * 10/2009 Patzer ..... A61M 5/1422 417/53
2010/0045096 A1 2/2010 Schonlau et al.
2012/0006303 A1 1/2012 Usui et al.
2012/0063925 A1 3/2012 Parker
2012/0289934 A1 * 11/2012 Greter ..... A61M 1/06 604/514

FOREIGN PATENT DOCUMENTS

KR 100677924 B1 5/2006
WO 2012/006464 A2 1/2012

OTHER PUBLICATIONS

ISA/US, International Search Report and Written Opinion issued on PCT application No. US16/28928, dated Aug. 8, 2016, 8 pages.

* cited by examiner

PERSONAL AIR SAMPLING PUMP ASSEMBLY

CROSS REFERENCE TO RELATED APPLICATION

This application is a non-provisional application claiming priority from U.S. Provisional Application Ser. No. 62/153,167, filed Apr. 27, 2015, and incorporated herein by reference in its entirety.

FIELD OF THE DISCLOSURE

The present description relates generally to a diaphragm air pump and more particularly to a personal air sampling pump assembly.

BACKGROUND OF RELATED ART

Personal air sampling pumps and controls are generally known. For instance, U.S. Pat. No. 3,814,552 describes a personal air sampling pump including a solenoid driven rubber diaphragm and rubber flapper check valves to control inlet and outlet flow. The diaphragm has a flexible annulus and a rigid central section and is used with independently timed drive pulses for essentially constant flow with varying load.

Similarly, U.S. Pat. No. 4,063,824 describes a constant flow air sampling pump including a variable drive pump that is connected to a filter and that is driven by an electric motor and is controlled by a feedback circuit of an integrator and an amplifier to maintain a constant flow of air through a dosimeter. The dosimeter is worn by an individual and at the termination of a period of time, such as a work day, the filter is removed and the collected contents are analyzed by conventional techniques such as gas chromatography to determine a level of exposure of the individual using the dosimeter.

Still further, U.S. Pat. No. 4,091,674 describes an electronically timed, positive displacement air sampling pump for use with air sample collecting devices in various environmental conditions. The device provides for average flow rate, independently metered total volume, operating time register and an audible "rate fault" alarm.

U.S. Pat. No. 5,107,713, describes a microprocessor controlled air sampling pump that utilizes a PWM controlled DC electric motor for regulating air flow generated by a diaphragm-type air pump. The control system regulates air flow as a function of the RPM of the motor by establishing a table of values which relate motor RPM to air flow rates. The control system maintains RPM at the desired value but includes a control loop which senses deviations in RPM and adjusts the PWM signals to the motor to regulate RPM.

While the identified devices may generally work for their noted purposes, there is an identifiable need for an improved personal air sampler as disclosed herein.

DETAILED DESCRIPTION

Figure 1:
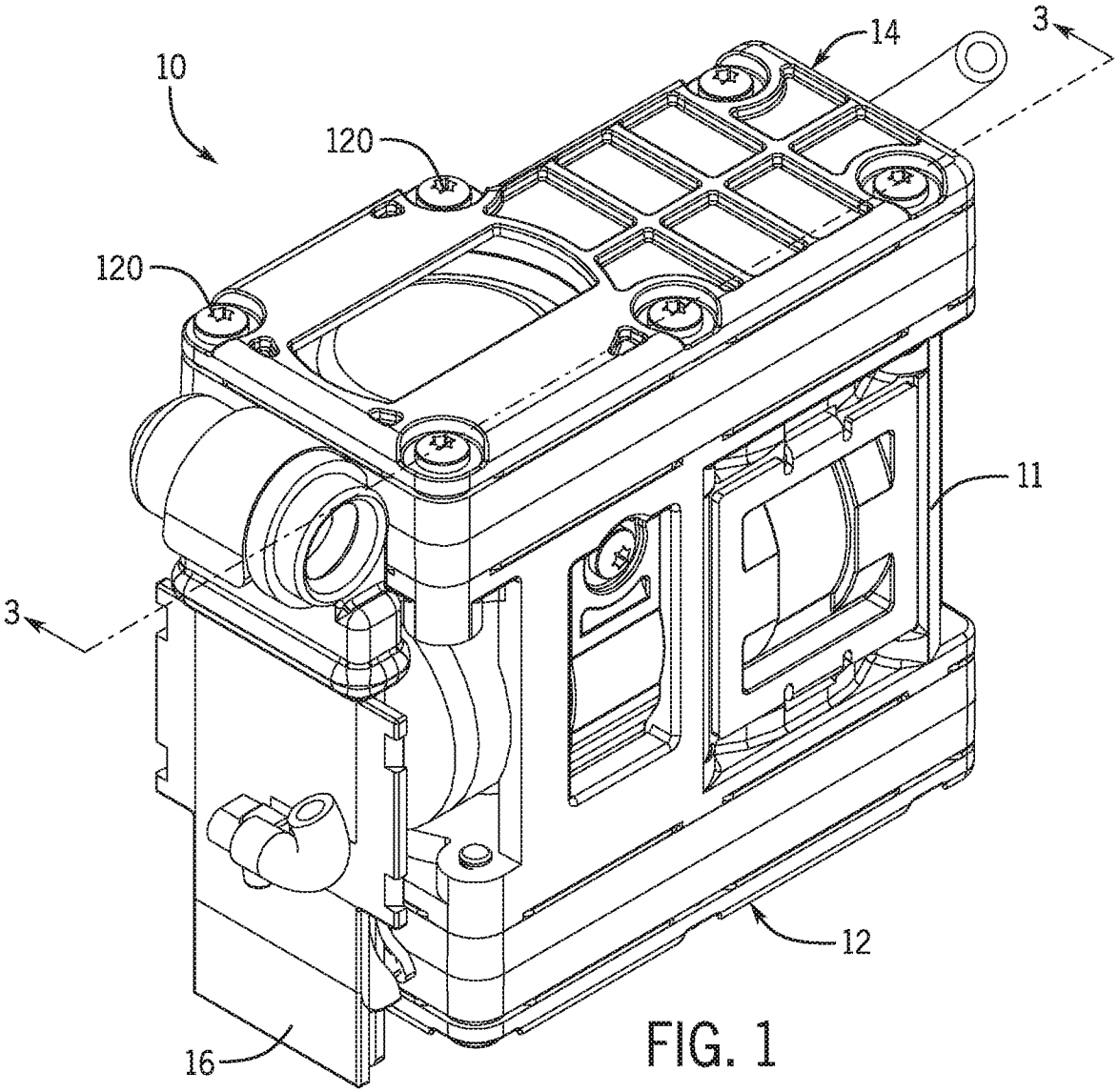
FIG. 1 is a front perspective view of one example of a personal air sampling pump assembly in accordance with the present disclosure.
Figure 2:
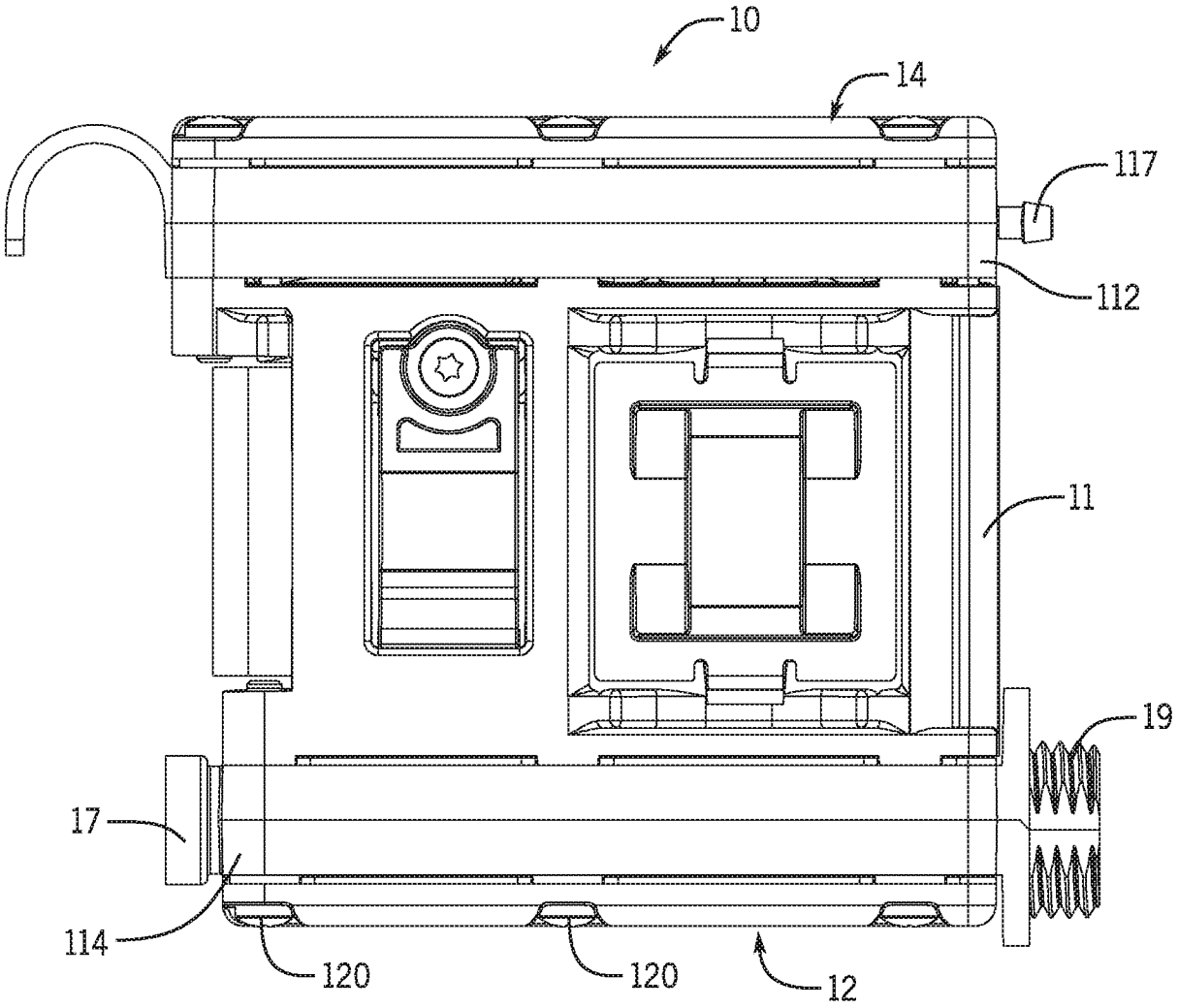
FIG. 2 is a side elevational view of the example personal air sampling pump assembly of FIG. 1.

The following description of example methods and apparatus is not intended to limit the scope of the description to the precise form or forms detailed herein. Instead the following description is intended to be illustrative so that others may follow its teachings.

The present disclosure is generally directed toward a rotary diaphragm air pump that integrates the function of piston head diaphragms, airflow flow pulsation dampers and sealing gaskets within a single compact housing assembly. In general, the layered design arrangement disclosed may reduce manufacturing cost, the number of component parts used to effect operation, and/or the overall product size. The present design may reduce assembly time and may create a 'fail-safe' assembly procedure that typically does not require the use of adhesives or sealants. As a result of the integrated design, a relatively optimal flow performance can be achieved with minimal flow pulsations.

In the personal air sampling pump application where particulate material may be collected onto a filter medium, low pulsation of the inlet airflow is oftentimes desired to prevent vibration of the collection filter and subsequent loss of the deposited material. A smooth airflow is also highly desired to ensure the correct performance of size-selective inlet devices such as cyclones. Furthermore, in at least some examples, the pulsation performance of the presently disclosed personal air sampling pump complies with the requirements of international Air Sampling Pump Standards such as ISO13137.

Referring now to FIGS. 1-10, an example of a personal air sampling pump assembly 10 is illustrated. It will be understood that in the present disclose, the terms fluid, air, gas, etc. may be equivalently utilized, and the operating principles of the present disclosure should not be limited to any specific gas, fluid, or mixture unless specifically stated otherwise. The example pump assembly 10 generally defines a housing comprising a motor housing 11, a first valve head and pulsation damper assembly 12 and a second valve head and pulsation damper assembly 14. In this example, the pump assembly 10 further includes an outlet assembly 16 fluidly coupled to the first valve head and pulsation damper assembly 12 via an outlet 17. The outlet assembly 16 may include a device or other suitable structure that for the purpose of outlet flow rate sensing. It will be understood that the outlet assembly may include and/or may be coupled to any suitable device to provide "further processing" on the outlet fluid including, for example, monitoring for toxins, radiation, etc. In operation, a motor 18 is used to drive an oscillatory linear motion of an articulated pump piston assembly 20 mounted within the motor housing 11. In this example, the articulated pump piston assembly 20 includes a dual piston setup 20*a*, 20*b*, with each of the pistons 20*a*, 20*b* coupled to drive an associated piston diaphragm. In particular, in this example, the oscillating motion of the piston and the piston diaphragm is used to pump air through a valve the valve head and pulsation damper assemblies 12, 14 as best viewed in FIGS. 4, 7A, 7B.

In one example, operation of the motor 18 may be controlled by a closed loop flow control system as disclosed in copending U.S. application Ser. No. 14/688,370, entitled "Air Sampler With Closed Loop Flow Control System," filed Apr. 16, 2015, and incorporated herein by reference in its entirety.

Figure 3:
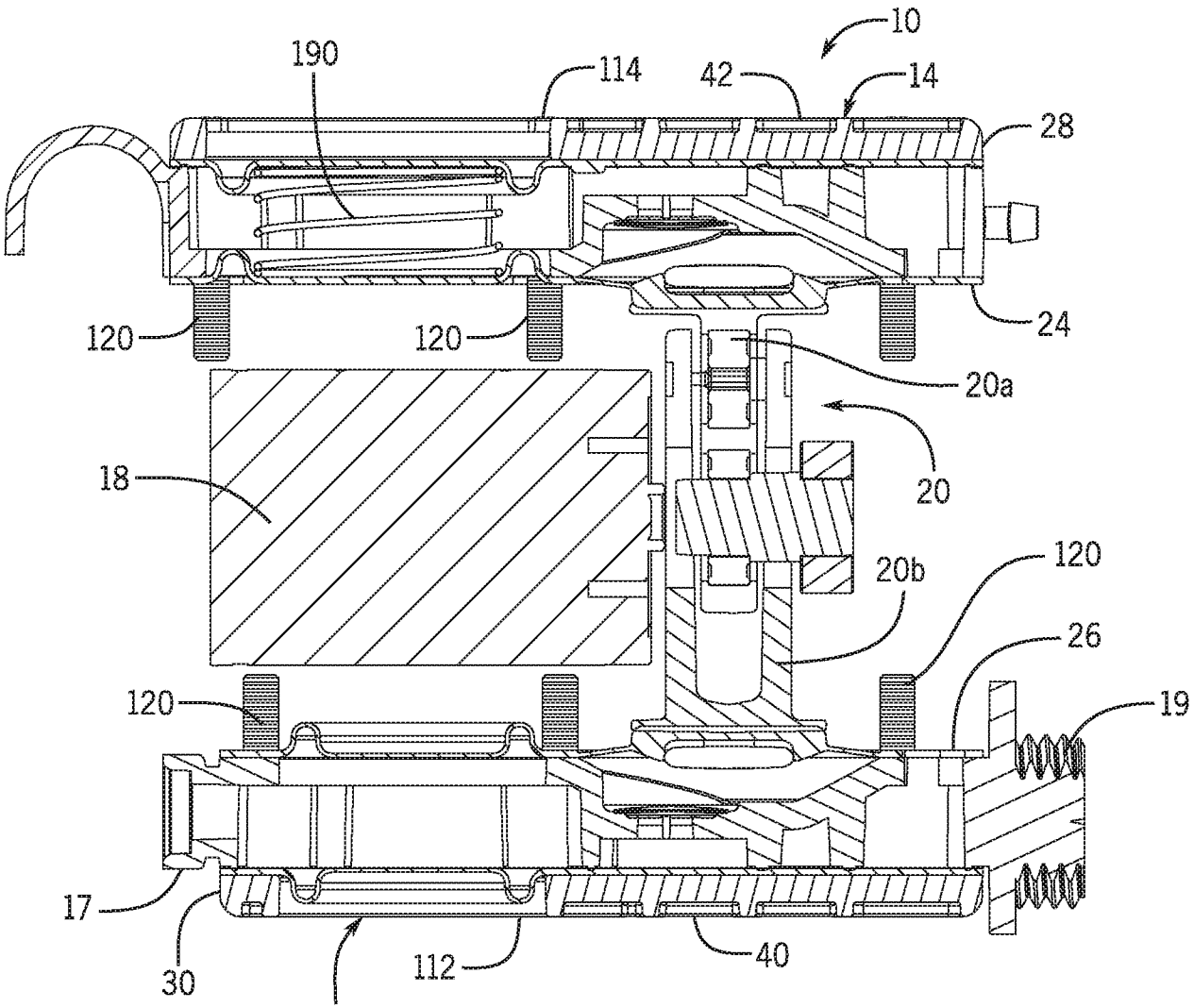
FIG. 3 is a cross sectional view of the example personal air sampling pump assembly of FIG. 1 taken along line 3-3.
Figure 7A:
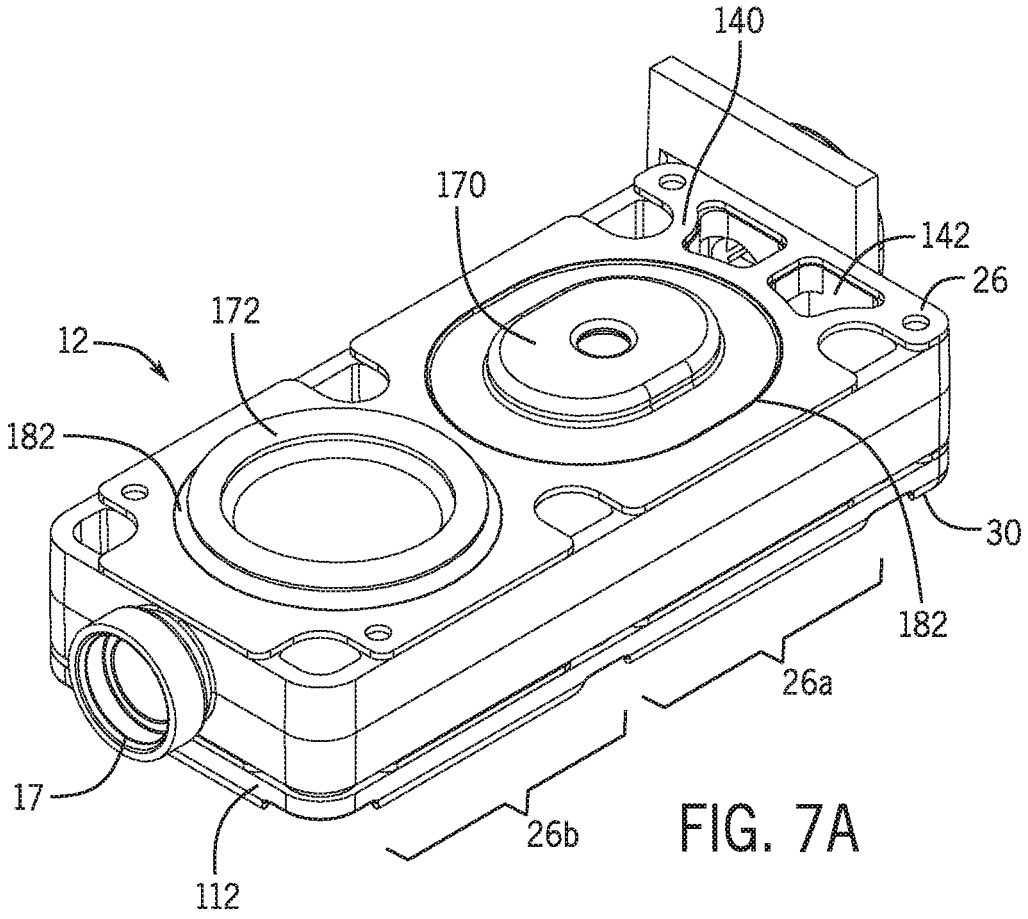
FIG. 7A is a perspective view of a valve chest with an inlet pulsation damper for use with the example personal air sampling pump assembly of FIG. 1.
Figure 7B:
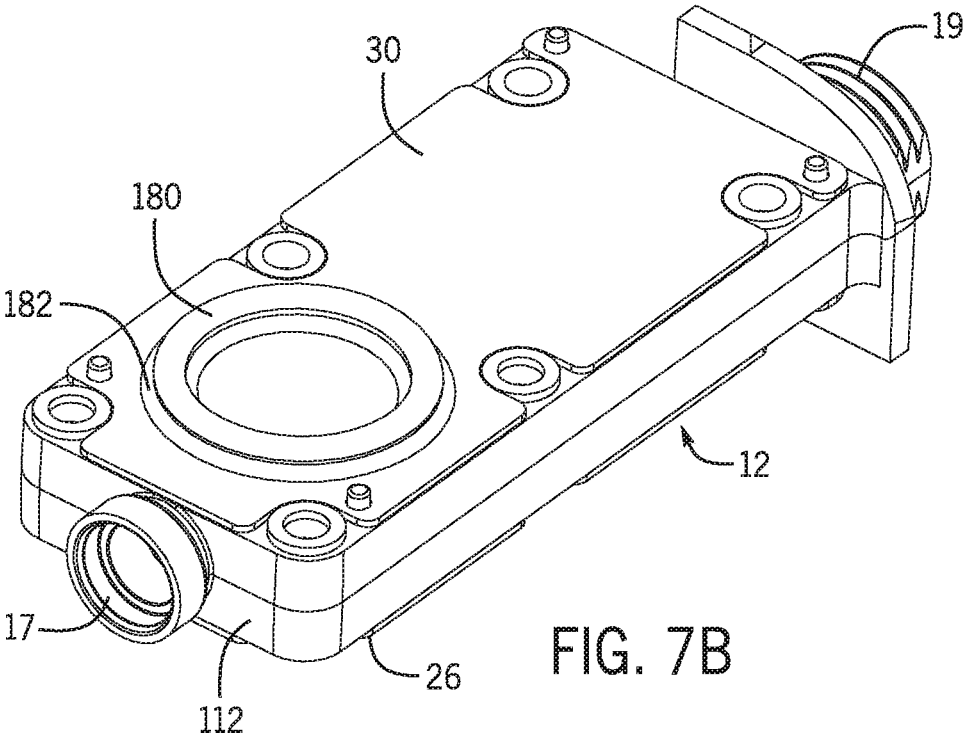
FIG. 7B is a reverse perspective the valve chest with an inlet pulsation damper of FIG. 7A.
Figure 8A:
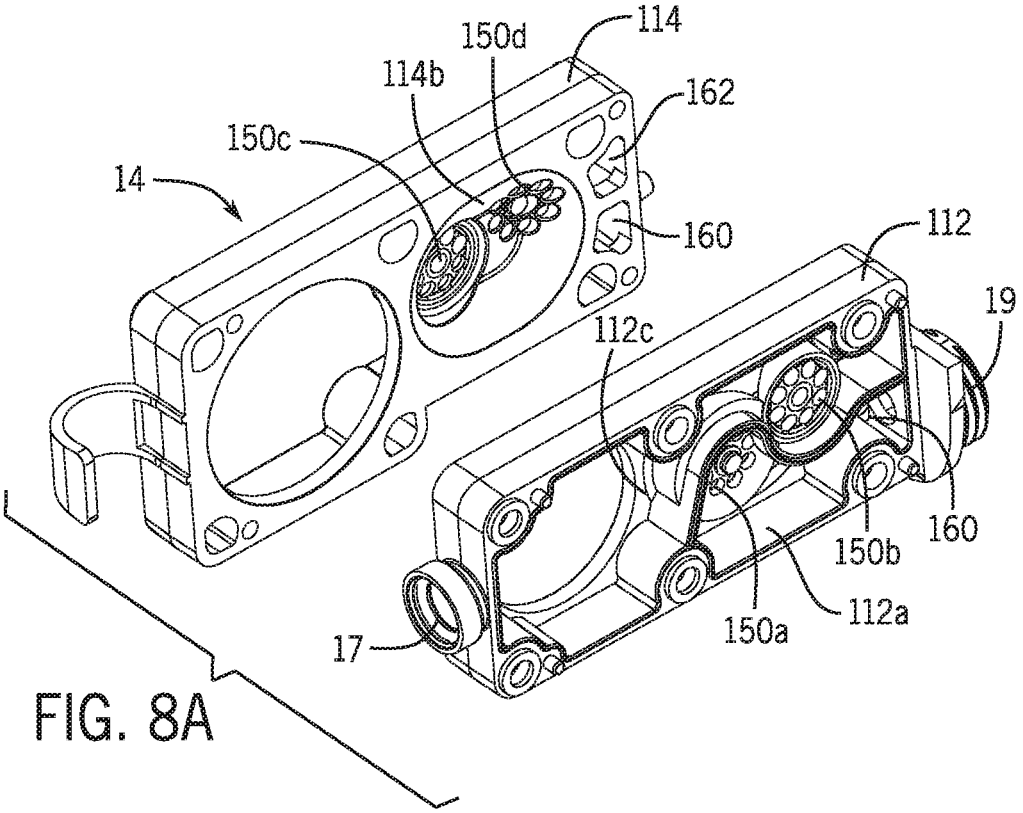
FIG. 8A is a perspective view of a two example valve head and pulsation damper assemblies for use with the example personal air sampling pump assembly of FIG. 1.
Figure 8B:
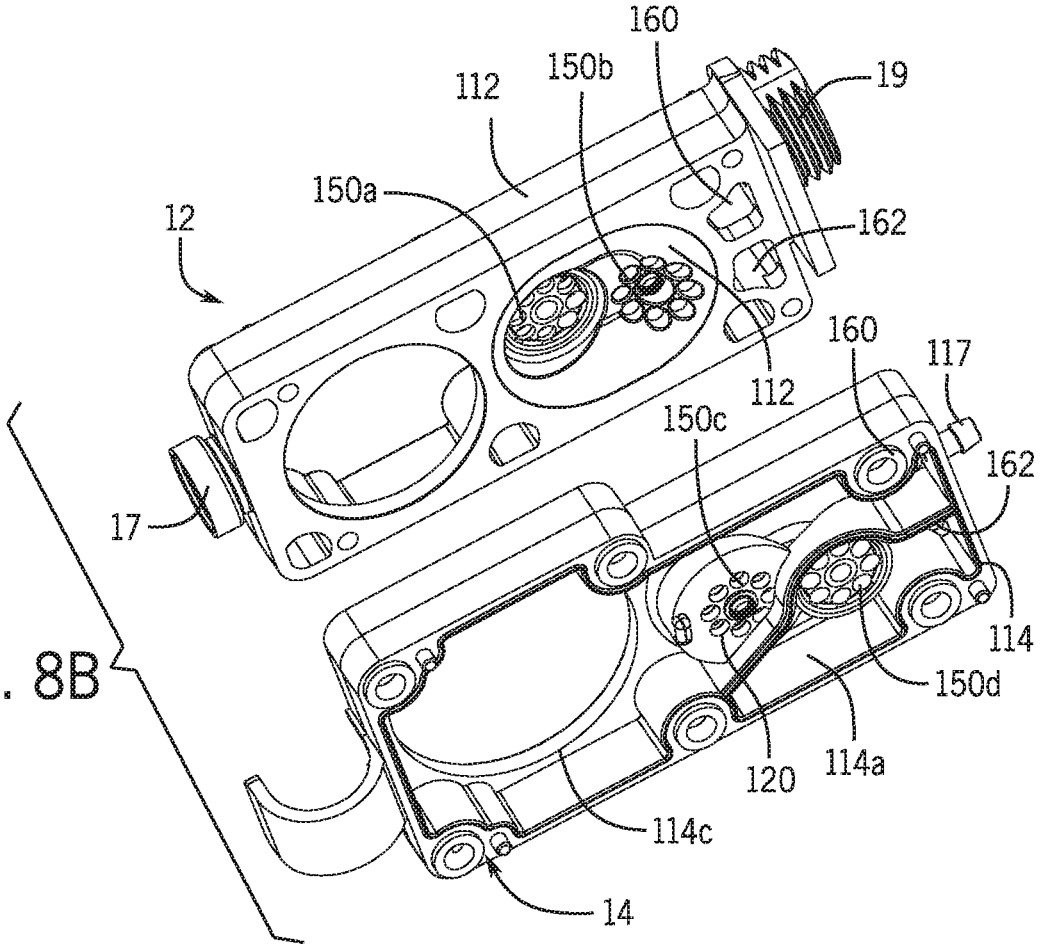
FIG. 8B is a reverse perspective view of the two valve head and pulsation damper assemblies of FIG. 8A.
Figure 9:
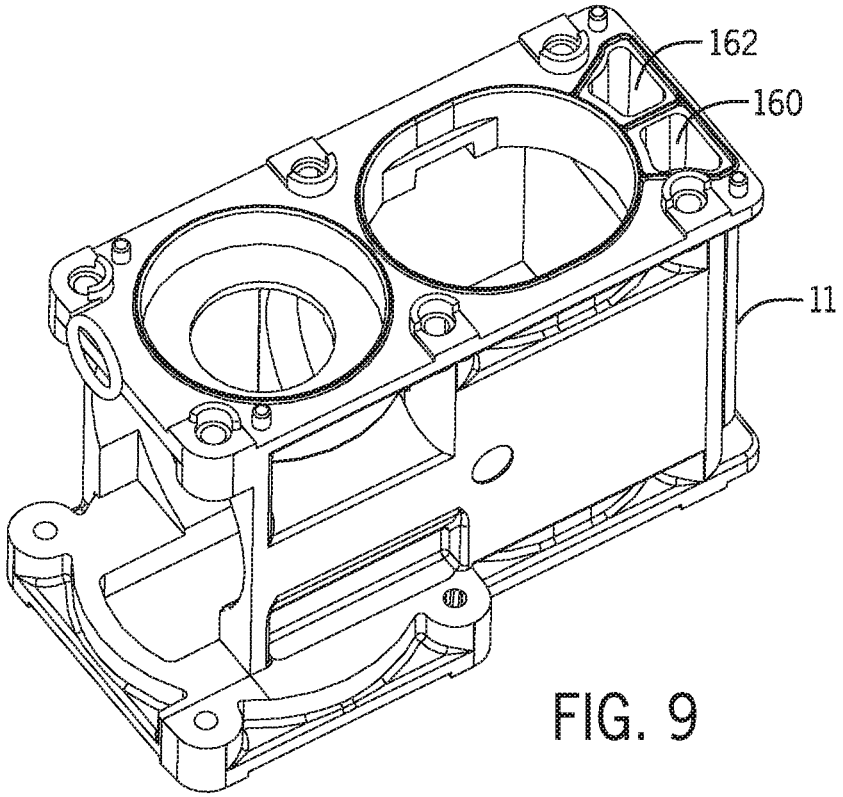
FIG. 9 is a perspective view of an example motor housing for use with the example personal air sampling pump assembly of FIG. 1.
Figure 10:
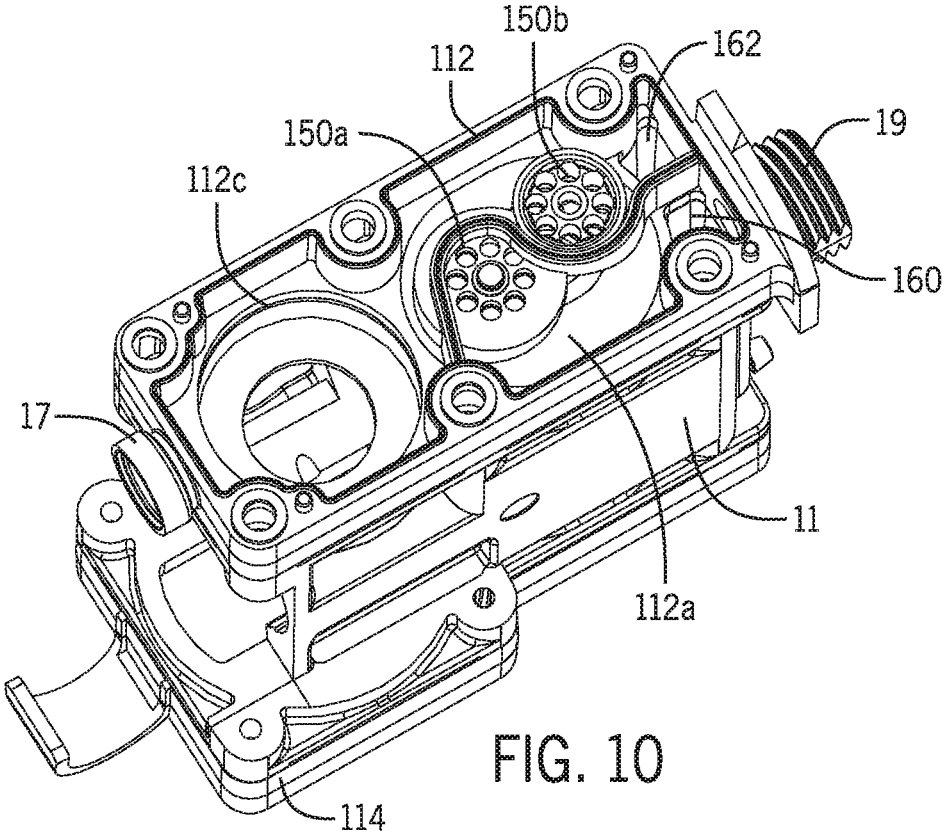
FIG. 10 is a perspective view of the motor housing of FIG. 9 coupled to the valve head and pulsation damper assemblies of FIGS. 8A and 8B.

Referring to FIG. 3, in this example, the valve head and pulsation damper assembly 14 forms a second air chamber, while the valve head and pulsation damper assembly 12 forms a first air chamber. Together, the pistons 20*a*, 20*b*, and the assemblies 12, 14, respectively form a piston diaphragm assembly. Each of the valve head and pulsation damper assemblies 14, 12 generally includes a housing or head, including for instance, a first valve head 112 and a second valve head 112. Each of the first head 112 and second head 114 includes a first elastomeric element 24, 26 that is coupled to one of the pistons 20*a*, 20*b*, and that seals one side of the associated head 112, 114. A second set of elastomeric elements 30, 32 are located on an opposite side of each of the valve heads 112, 114 to seal the second side of the valve head. Each of the valve heads 112, 114, may additionally be sealed via a cover plate 40, 42 securely fastened to the associated head 112, 114 via any suitable method, including via a plurality of fasteners, such as threaded fasteners 120. It will be appreciated that FIGS. 7A and 7B illustrate one example of the valve head and pulsation damper 12. The example assembly 12 includes the valve head 112, with elastomeric elements 26, 30 sealing coupled to either side of the valve head 112. The valve head 112 includes an inlet 19 in addition to the outlet 17. As will be described in detail herein, the valve head 112 and the elastomeric element 26 includes a plurality of apertures 140, 142 to allow fluid communication between the valve heads 112, 114 through a first conduit 160 and a second conduit 162 formed in the motor housing 11.

Referring to FIGS. 8A, 8B, and FIGS. 3 and 4, each of the valve heads 114, 112, defines various air chambers 112*a*, 112*b*, 112*c*, and 114*a*, 114*b*, 114*c*, respectively. In the illustrated example, the various air chambers 112*a*, 112*b*, 112*c*, and 114*a*, 114*b*, 114*c* are fluidly coupled via a plurality of apertures 150. Each of the apertures 150 may include a check valve 152, which are each hidden in FIGS. 8A, 8B, but are visible in FIGS. 3 and 4. As is known in the art, the check valves 152 may be utilized to provide for a single airflow direction and to prevent air from flowing in a non-desired direction.

Accordingly, in this example construction, the inlet 19 is fluidly coupled to the air chamber 112*a* and also to the conduit 160. The air chamber 112*a* is fluidly coupled to the air chamber 112*b* through a first set of apertures 150*a* and one of the check valves 152. The air chamber 112*b* is subsequently fluidly coupled to the air chamber 112*c* though a second set of apertures 150*b* and another one of the check valves 152. The conduit 162 is similarly fluidly coupled to the air chamber 112*c*. Finally, the air chamber 112*c* is fluidly coupled to the outlet 17.

Referring to the valve head 114, the air chamber 114*c* is fluidly coupled to the conduit 160 to receive air from the valve head 112. An outlet 117 is provided in the valve head 114 and in this instance may be coupled to a pressure sensor (not shown) to monitor the pressure of the device 10. It will be appreciated that the outlet 117 may be coupled to any device, conduit, sensor, or other suitable device as desired. The air chamber 114*c* is coupled to the air chamber 114*b* through a third set of apertures 150*c* including another one of the check valves 152. Next, the air chamber 114*b* is coupled to the air chamber 114*a* and the conduit 162 through a fourth set of apertures 10*d* including a further one of the check valves 152. As noted above, the conduit 162 is fluidly coupled to the air chamber 112*c* through the motor housing 11.

Figure 4:
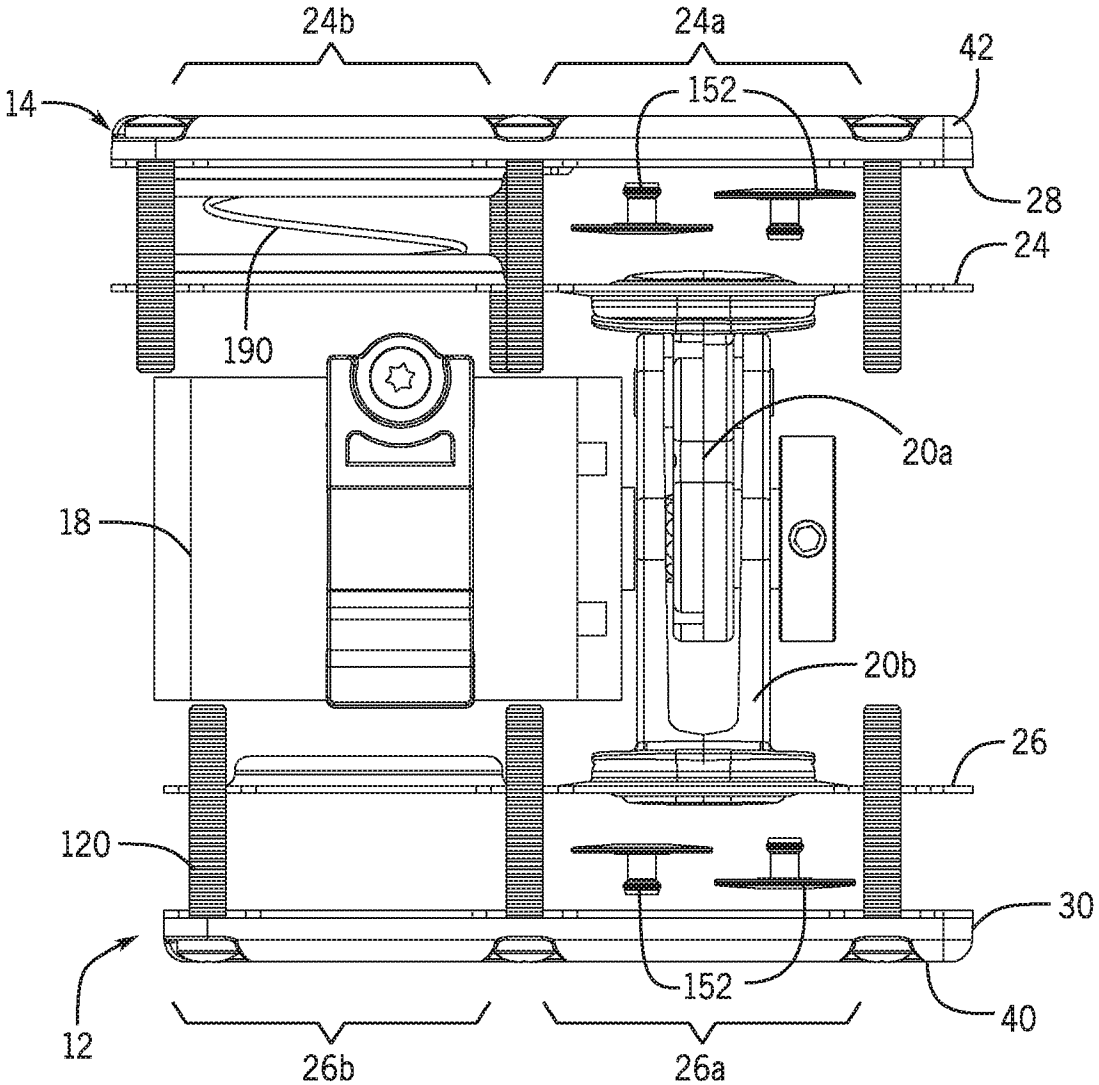
FIG. 4 is a side elevational view of the example personal air sampling pump assembly of FIG. 1 with a portion of the housing removed.
Figure 5:
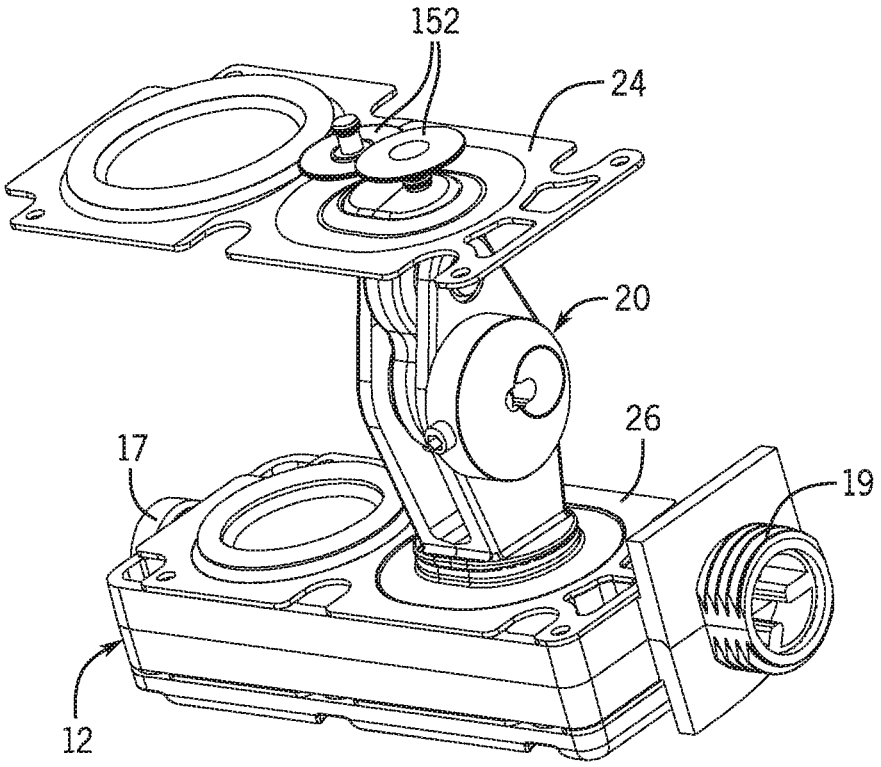
FIG. 5 is a perspective view of the example personal air sampling pump assembly of FIG. 1 with additional components removed to show additional details of the motor and piston assembly.
Figure 6:
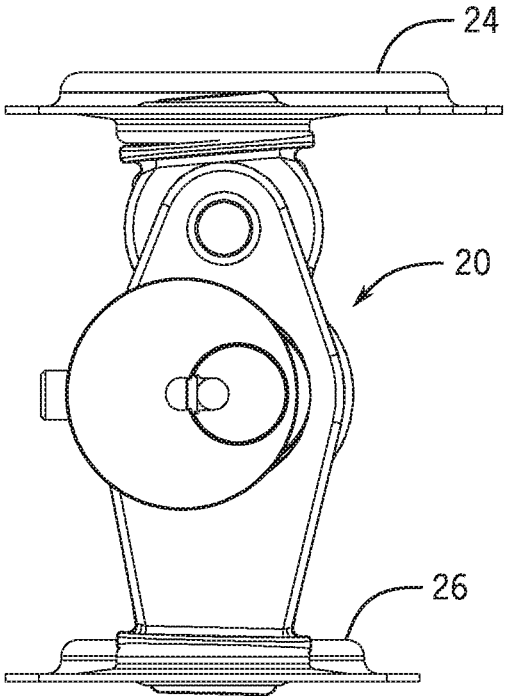
FIG. 6 is a side elevational view of the example personal air sampling pump assembly of FIG. 1 showing the motor and pistons coupled to the first elastomeric diaphragms.

As will be appreciated, each of the elastomeric membranes 24, 26, 28, 30 serves to perform multiple functions and, in this example as illustrated in FIG. 4, generally includes a piston diaphragm portion 24*a*, 26*a*, and a pulsation damper membrane portion 24*b*, 26*b*, respectively. In particular, for each assembly 14, 12, the layered construction includes multiple elastomeric diaphragms separated by a valve head as described above. Each of the first elastomeric elements is generally considered an elastomeric piston diaphragm molding. As shown in FIG. 7A, the example elastomeric element 26 provides a sealing gasket between the motor housing 11 (removed in FIG. 7A) and the valve head 112, and includes a pump diaphragm membrane 170 which is coupled to one of the pistons 20, and a flexible damper membrane 172. Meanwhile, as illustrated in FIG. 7B, the example elastomeric element 30 similarly provides a sealing gasket between the cover plate 40 (removed in FIG. 7B) and the valve head 112, and includes a flexible damper membrane 180.

Although not illustrated in FIGS. 7A and 7B, the construction of the valve head and pulsation damper assembly 14 may be similar to the construction described in relation to the illustrated valve head and pulsation damper assembly 12, or may be any suitable design. Furthermore, the layered construction of the present disclosure may be applicable to a single acting (i.e., a single piston diaphragm assembly) or a double action pump design as disclosed herein.

As illustrated, the elastomeric elements 26, 30 may include a plurality of raised line features such as the raised line future 182, on the surface of the respective elements 11, 112, 114, 40, and 42 to locally increase the compressive force applied to the membrane and to aid in sealing the entire assembly.

The pulsation damper membrane portions 24*b*, 26*b* are generally formed from the combination of the flexible elastomeric damper membranes 26, 30 and the enclosed air chamber 112*c* formed within the valve head 112. The combination of the elastic structure and the associated cavity volume reduces the amplitude of pulsations in the pump's inlet and outlet airflow. In addition, as shown in FIG. 4, the damper membrane portions 24*b*, 26*b*, may optionally include a spring 190, such as a coil spring, or other suitable mechanism to alter the spring characteristics of the membranes 26, 30 and the damper response. Further, the flow pulsation dampener portion 24*b*, 26*b* generally reduces the level of pulsations induced by the actions of the diaphragm. In a typical personal sampling pump, the magnitude of pulsations in the air flow velocity leads to changes in the performance characteristics of size selective sampling heads such as cyclones.

As will be appreciated by one of ordinary skill in the art, the action of the reciprocating piston 20 against the piston diaphragm portion 24*a*, 26*a* may be used to create a positive or negative air pressure pumping effect as desired. The piston diaphragm portion 24*a*, 26*a* are used to move a volume of gas or air, and the elastomeric membranes 24, 26, 28, 30 are stretched across the valve heads 112, 114 and not physically bonded thereto. In operation, the motor 20 including eccentric connecting rods create oscillatory pumping motion in the elastomeric membranes 24, 26.

Figure 11:
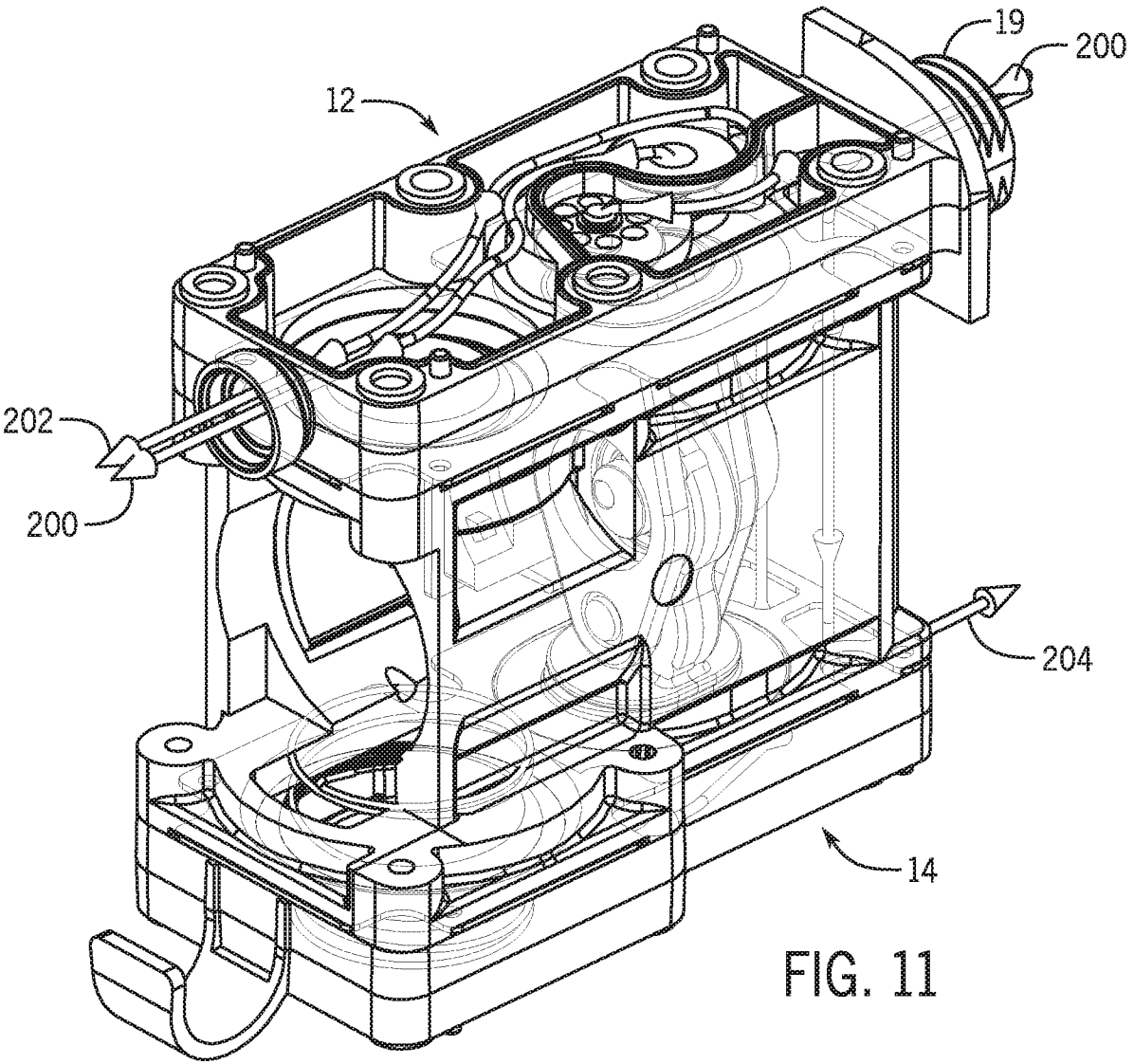
FIG. 11 is a transparent perspective view of the example personal air sampling pump assembly of FIG. 1 showing an example fluid flow path.
Figure 12:
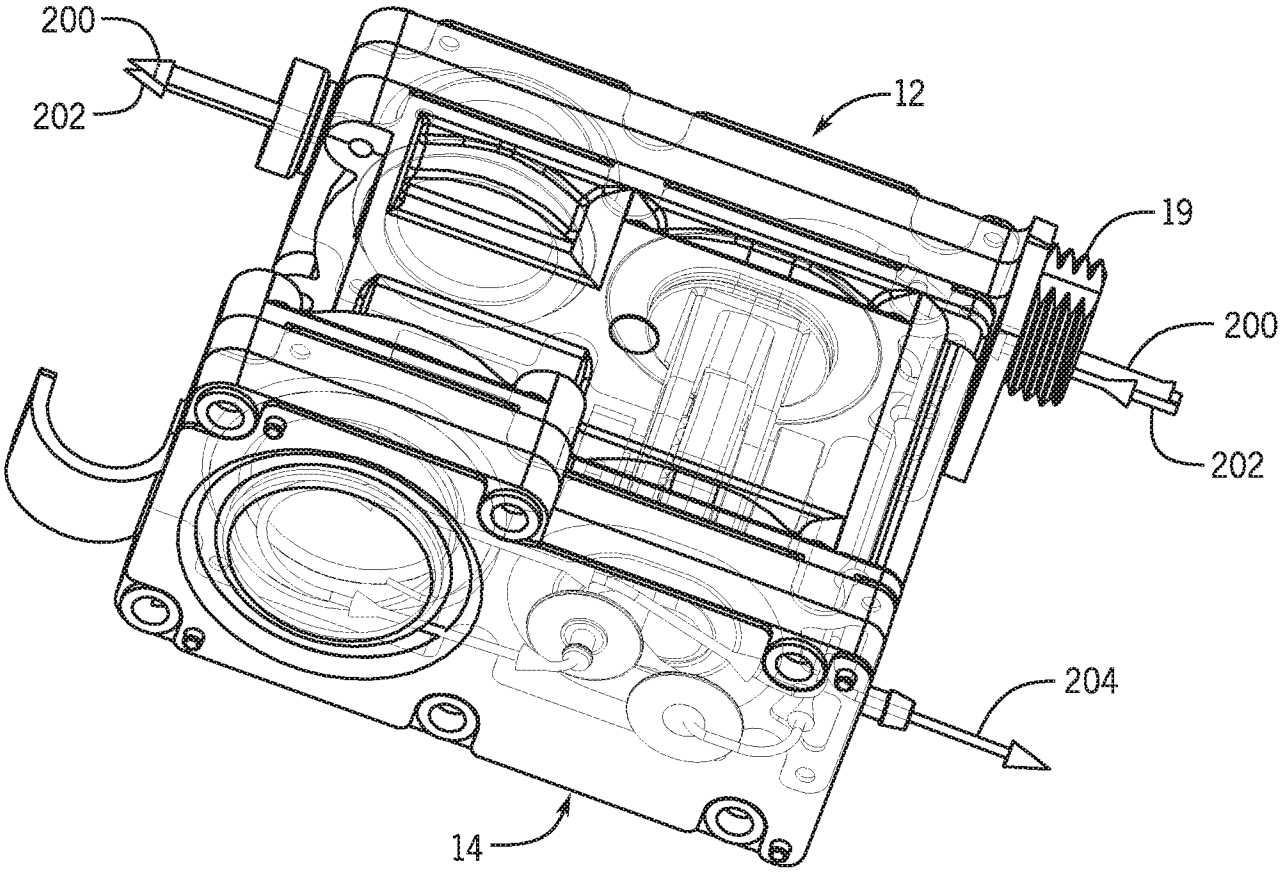
FIG. 12 is an alternative perspective view of FIG. 11 additionally showing the example fluid flow path.

The movement caused by the piston diaphragm assemblies is used to move a volume of fluid, gas, or air as illustrated in FIGS. 11 and 12. In general, air enters into the assembly 10 at the inlet 19 and flows one of two fluid paths 200, 202 as shown. In the first path 200, the air enters the inlet 19 and travels through the three air chambers 112*a*, 112*b*, 112*c*, under influence of air pressure caused by the operation of the piston diaphragms portions 24*a*, 26*a*, and exits the assembly 10 at the outlet 17, where it may travel through the outlet assembly 16 for flow sensing and/or other suitable processing, or through any other suitable device. At the same time, at least a portion of the air entering at the inlet 19 may travel via the second air path 202 into the conduit 160 and into the air chambers 114*a*, 114*b*, 114*c*. As noted above, a portion of the air 204 may be bled through the outlet 117 for any suitable purpose, including for instance, for pressure sensing. The air may then return to the valve head 112 and specifically the air chamber 112*c* through the conduit 162, where the air may similarly exit through the outlet 17.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A personal air sampling pump assembly comprising:

a motor;

a piston mounted to the motor, the piston being driven by the motor to reciprocate along a first line;

a diaphragm assembly, extending in a first direction that is transverse to the first line, operably coupled to the piston, the diaphragm assembly comprising:

a valve head including a fluid inlet and a fluid outlet and defining a fluid chamber fluidly coupling the fluid inlet and the fluid outlet and forming a fluid path from the fluid inlet to the fluid outlet;

a first diaphragm, located on a first side of the valve head and sealing engaging the valve head, the first diaphragm comprising a piston diaphragm membrane portion, coupled to the piston for reciprocating with the piston and enclosing, at all times, a first portion of the fluid chamber, and a first damper membrane portion, spaced from the piston diaphragm membrane portion in the first direction and enclosing, at all times, a second portion of the fluid chamber;

a second diaphragm, located on a second side of the valve head opposite the first side in a second direction that is parallel to the first line, sealing engaging the valve head, the second diaphragm comprising a second damper membrane portion enclosing, at all times, a third portion of the fluid chamber; and a check valve disposed within the fluid path;

wherein each reciprocation of the piston causes a change in air pressure within the fluid chamber to cause air to move from the fluid inlet toward the fluid outlet, the change in air pressure causes a corresponding movement of both the first damper membrane portion of the first diaphragm and the second damper member of the second diaphragm, and the corresponding movements of the first damper membrane portion of the first diaphragm and the second damper membrane of the second diaphragm cooperate to reduce an amplitude of pulsation in airflow at the fluid inlet and fluid outlet as the air is caused to move from the fluid inlet toward to fluid outlet in response to each reciprocation of the piston.

2. The personal air sampling pump assembly as recited in claim 1, further comprising a second piston mounted to the motor for reciprocal motion.

3. The personal sampling pump assembly as recited in claim 2, further comprising a second diaphragm assembly operably coupled to the second piston, the second diaphragm assembly comprising:

a second head including a second fluid inlet and a second fluid outlet and defining a second fluid chamber fluidly coupling the second fluid inlet and the second fluid outlet and forming a second fluid path from the second fluid inlet to the second fluid outlet;

a third diaphragm sealing engaging the second head comprising a piston diaphragm membrane portion, coupled to the second piston for reciprocating with the second piston and enclosing, at all times, a first portion of the second fluid chamber, and a third damper membrane portion enclosing, at all times, a second portion of the second fluid chamber;

a fourth diaphragm sealing engaging the second head comprising a fourth damper membrane portion enclosing, at all times, a third portion of the second fluid chamber; and a check valve disposed within the second fluid path, wherein reciprocation of the second piston causes a change in air pressure within the second fluid chamber to cause air to move from the second fluid inlet toward the second fluid outlet.

4. The personal air sampling pump assembly as recited in claim 3, wherein the air chamber of the valve head includes a conduit fluid outlet and a separate conduit fluid inlet and further comprising:

a first conduit fluidly coupling the conduit fluid outlet to the second fluid inlet of the second head; and a second conduit fluidly coupling the second fluid outlet of the second head to the conduit fluid inlet.

5. The personal air sampling pump assembly as recited in claim 4, further comprising a motor housing for supporting the motor.

6. The personal air sampling pump assembly as recited in claim 5, wherein the diaphragm assembly and the second diaphragm assembly are each mounted to the motor housing.

7. The personal air sampling pump assembly as recited in claim 6, wherein at least one of the first conduit and the second conduit are integrally formed within the motor housing.

8. The personal air sampling pump assembly as recited in claim 4, wherein at least one of the first or second head includes a pressure sensor.

9. The personal air sampling pump assembly as recited in claim 1, wherein the damper membrane portion of the first diaphragm is resiliently coupled to the damper membrane portion of the second diaphragm.

10. The personal air sampling pump assembly as recited in claim 9, wherein the damper membrane portion of the first diaphragm is resiliently coupled to the damper membrane portion of the second diaphragm via a coil spring.

11. The personal air sampling pump assembly as recited in claim 1, wherein the fluid chamber comprises:

a first fluid sub-chamber fluidly coupled to the fluid inlet;

a second fluid sub-chamber fluidly coupled to the first fluid sub-chamber via a first aperture; and a third fluid sub-chamber fluidly coupled to the second fluid sub-chamber via a second aperture and fluidly coupled to the fluid outlet.

12. The personal air sampling pump assembly as recited in claim 11, wherein the check valve is sealingly mated to the first aperture to substantially prevent fluid from traversing from the second fluid sub-chamber to the first fluid sub-chamber.

13. The personal air sampling pump assembly as recited in claim 12, further comprising a second check valve sealingly mated to the second aperture to substantially prevent fluid from traversing from the third fluid sub-chamber to the second fluid sub-chamber.

14. The personal air sampling pump assembly as recited in claim 11, wherein the piston diaphragm membrane portion is operably coupled to the second fluid sub-chamber.

15. The personal air sampling pump assembly as recited in claim 11, wherein the damper membrane portion of the first and second diaphragms are operably coupled to the third fluid sub-chamber.

16. The personal air sampling pump assembly as recited in claim 1, wherein the fluid inlet and the fluid outlet of the valve head are disposed intermediate the first side and the second side of the valve head.

17. The personal air sampling pump assembly as recited in claim 1, wherein the fluid inlet and the fluid outlet of the valve head provide the only connection between the fluid chamber defined in the valve head and air external to the personal air sampling pump assembly.

* * * * *